US005142259A

United States Patent [19]

Kelaita, Jr. et al.

[11] Patent Number: 5,142,259

[45] Date of Patent: Aug. 25, 1992

[54] MOLDED CASE CIRCUIT BREAKER WITH LOW FRICTION LATCH ARRANGEMENT

[75] Inventors: Joseph B. Kelaita, Jr., Bristol; Roger N. Castonguay, Terryville, both of Conn.

[73] Assignee: General Electric Company, New York, N.Y.

[21] Appl. No.: 700,821

[22] Filed: May 16, 1991

[51] Int. Cl.[5] ..... H01H 9/20

[52] U.S. Cl. ..... 335/167; 335/22

[58] Field of Search ..... 335/21-24, 335/35, 6, 167-175, 185-190

[56] References Cited

U.S. PATENT DOCUMENTS 2,057,380 10/1936 Keefe ..... 335/78
3,488,611 1/1970 Harper ..... 335/126
3,810,051 5/1974 Walker et al. .
4,472,698 9/1984 Siffroi et al. ..... 335/195
4,550,300 10/1985 Jencks et al. .
4,911,624 3/1990 Bagepalli .

*Primary Examiner*—Lincoln Donovan
*Attorney, Agent, or Firm*—Richard A. Menelly; Fred Jacob

[57] ABSTRACT

The secondary latch of a molded case circuit breaker latching arrangement is formed from a latching pin assembly with a solid metal latching sphere rotatably mounted at one end thereof. The latching sphere contacts the operating mechanism latching plate to provide a low-friction latching force to the circuit breaker operating mechanism. The latching sphere contacts the latching plate and is continuously lubricated by means of a lubrication reservoir integrally-formed within the latch pin assembly.

8 Claims, 1 Drawing Sheet

MOLDED CASE CIRCUIT BREAKER WITH LOW FRICTION LATCH ARRANGEMENT

BACKGROUND OF THE INVENTION

Industrial-rated circuit breakers generally include a primary and secondary latching arrangement for providing adequate latching of the circuit breaker operating mechanism while maintaining a low level tripping force to release the operating mechanism under overcurrent circuit conditions of predetermined duration.

U.S. Pat. No. 4,550,300 entitled "Latch Release Mechanism for Molded Case Electric Circuit Breakers" describes the arrangement of one such primary and secondary latch assembly.

When a so-called "latch pin" is used in contact with the latch plate, the end of the latch pin in contact with the latch plate must be carefully machined and polished and arranged in a manner to ensure adequate latching of the operating mechanism cradle to prevent the cradle from rotation against the bias force exerted by the powerful operating mechanism springs while allowing a relatively moderate tripping force to move the latch pin away from the latching plate to thereby release the cradle.

U.S. Pat. No. 3,810,051 entitled "Circuit Breaker Trip and Latch Mechanism" describes the use of a roller or rotating pin in contact with the latch lever to minimize the friction between the latch pin and the latch lever.

U.S. Pat. No. 4,911,624 entitled "Reduced Friction Vane Design for Rotary Compressors" describes the use of a roller within a rotary compressor to provide rolling contact with a rolling piston within the compressor. An oil reservoir maintains a constant supply of oil to the roller to reduce friction and wear.

One purpose of the instant invention is to provide a secondary latch pin which maintains sufficient latching force to restrain the circuit breaker operating mechanism during quiescent circuit conditions while allowing a reduced tripping force to release the circuit breaker operating mechanism under overload circuit conditions.

SUMMARY OF THE INVENTION

A secondary latch pin in a molded case circuit breaker operating mechanism is provided with a solid metal latching sphere rotatably arranged at one end for latching the operating mechanism secondary latch plate. A lubrication reservoir formed within the latch pin provides constant lubrication to the sphere while a compression spring within the latch pin prevents the lubrication from leaking from the lubrication reservoir when the circuit breaker operating mechanism is unlatched.

DESCRIPTION OF THE PREFERRED EMBODIMENT

Figure 1:
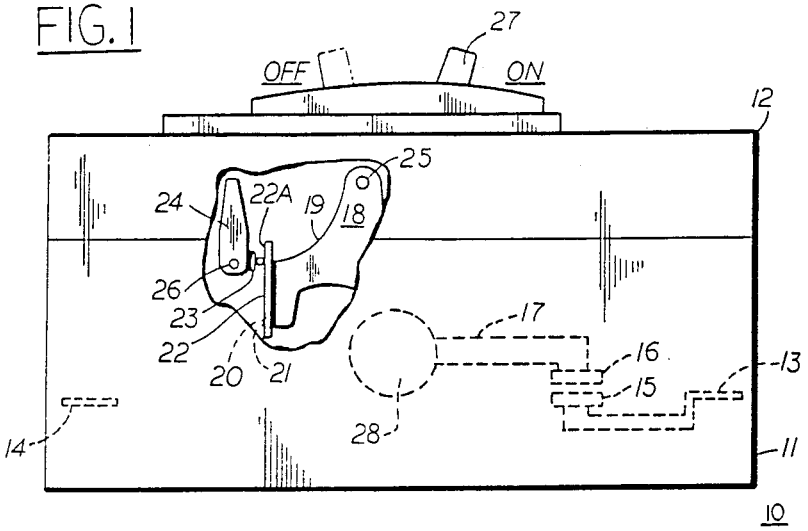
FIG. 1 is a side view of an industrial-rated circuit breaker including the latching pin assembly according to the invention.

An industrial-rated circuit breaker 10 such as that described in aforementioned U.S. Pat. No. 4,550,300 is depicted in FIG. 1 and consists of a plastic case 11 to which a plastic cover 12 is fixedly attached. Electrical connection with an electrical power distribution circuit is made by means of the line terminal 13 at one end of the circuit breaker case and by means of the load terminal 14 at the opposite end thereof. The circuit current proceeds through a pair of fixed and movable contacts 15, 16 and hence through a movable contact arm 17 to which the movable contact is affixed. The crossbar 28 cooperates with the circuit breaker operating mechanism, generally depicted at 18, to hold the movable contact arm in the closed position against the return bias of a pair of powerful operating springs (not shown). The operating mechanism includes a cradle operator 19 that is pivotally attached to the operating mechanism by means of the cradle pivot pin 25. The cradle hook 21 formed at one end of the cradle operator sits within a primary latch slot 20 formed within the rotatably-mounted latch plate 22. The engagement between the cradle hook and the latch slot is considered the primary latching arrangement for the operating mechanism 18. The secondary latching arrangement for the operating mechanism consists of the engagement between the latch pin assembly 23 and the top part 22A of the latch plate 22. Upon the occurrence of an overcurrent condition through the circuit breaker contacts, the trip bar 24 is rotated in the clockwise direction about pivot pin 26 to move the latch pin assembly 23 away from the latch plate and thereby allow the cradle operator 18 to rotate free of the latch slot 20 and allow the movable contact arm 17 and attached movable contact 16 to rapidly rotate in the counterclockwise direction to thereby interrupt the circuit current. The circuit breaker handle 27 is used to separate the circuit breaker contacts under quiescent circuit conditions.

Figure 2:
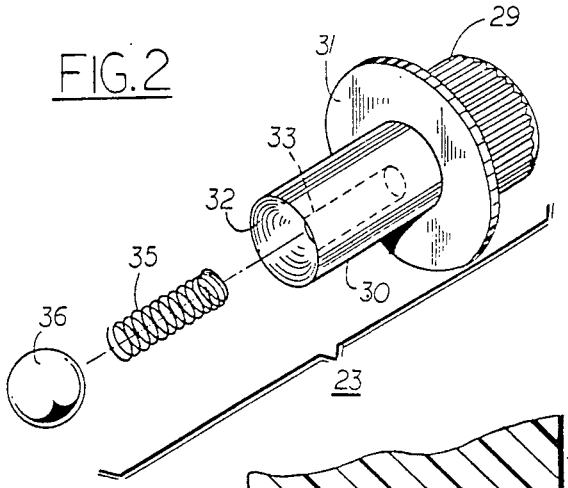
FIG. 2 is an enlarged top perspective view of the latching pin assembly of FIG. 1 prior to assembly.

The latch pin assembly 23 includes a fluted support pin 29 and a cylindrical latch pin 30 separated by means of a collar 31 as shown in FIG. 2. A central channel 33 formed within the latch pin is closed at one end. A quantity of lubricating grease (not shown) is inserted within the central channel 33 and a compression spring 35 is next positioned within the central channel. The solid steel sphere 36 in the form of a ball bearing, is next positioned within the dish-shaped opening 32 formed at the end of the latch pin and a part of the dish-shaped opening is peened over to retain the sphere while allowing the sphere to freely rotate.

Figure 3:
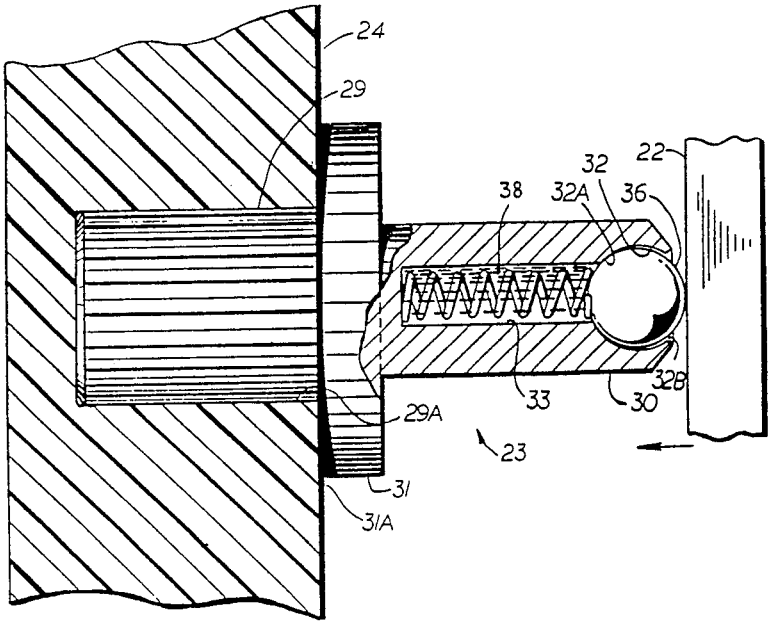
FIG. 3 is an enlarged side sectional view of the latching pin assembly of FIG. 1 in contact with the latch plate.

The attachment between the pin assembly 23 and the circuit breaker operating mechanism plastic trip bar 24 is best seen by referring now to FIG. 3. The fluted base pin 29 is press-fit within an aperture in the trip bar as indicated at 29A and the cylindrical collar 31 stops against the upper surface of the trip bar as indicated at 31A. The fluted surface on the base pin prevents the rotation of the latch assembly when attached to the trip bar. The latch pin assembly is depicted in the "latched" position with the latching sphere 36 in contact with the latch plate 22 such that the force exerted in the direction of the indicating arrow moves the latching sphere against the rear surface 32A of the dish-shaped opening 32. The lubricating grease 38 is held within the channel 33 by contact between the latching sphere and the rear surface of the dish-shaped opening 32. The opposite end of the latching sphere is away from the peened end of the latch pin 30 as indicated by the gap 32B.

Figure 4:
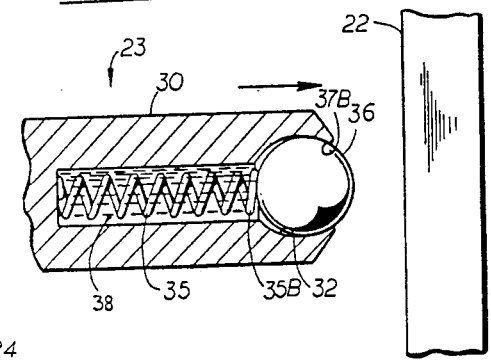
FIG. 4 is an enlarged sectional view of a part of the latching pin assembly of FIG. 3 away from the latching plate.

When the latch pin assembly 23 is out of contact with the latch plate 22, as depicted in FIG. 4, the end 35B of the spring 35 forces the latching sphere 36 against the peened end of the dish-shaped opening 32 as depicted at 37B. The force generated by the spring on the latching sphere is in the direction of the indicating arrow. This seals the end of the dish-shaped opening 32 and thereby prevents loss of the lubricating grease 38 which is quite viscous at the high operating temperatures inhibited during the extreme overcurrent conditions.

A low friction latching arrangement has herein been described for use within industrial-rated circuit breakers. The use of a spring-loaded latching sphere and a reservoir of lubricating grease ensures that the friction generated between the latching sphere and the operating mechanism latch plate will be at a minimum and constant value.

Having thus described our invention, what we claim as new and desire to secure by Letters Patent is:

1. A molded case circuit braker comprising:

a molded plastic case and cover;

a pair of separable contacts within said case; an operating mechanism within said case arranged for separating said contacts upon occurrence of an overcurrent condition through said contacts;

a latch assembly within said case interacting with said operating mechanism to deter said operating mechanism from separating said contacts upon quiescent current conditions through said contacts said latch assembly including a latch pin having a rotatable latch sphere arranged at one end and a dish-shaped opening at an end opposite said one end, said sphere being rotatably arranged within said dish-shaped opening; and a latch plate releasably interfacing with said latch sphere, said latch plate interacting with a trip bar pivotally-mounted within said case.

2. The circuit braker of claim 1 wherein said latch pin includes a hollow channel closed at one end.

3. The circuit breaker of claim 1 wherein said dish-shaped opening is partially formed-over to retain said sphere within said dish-shaped opening.

4. The circuit breaker of claim 3 including a spring within said channel, one end of said spring contacting a part of said sphere for biasing said sphere against said formed-over dish-shaped opening.

5. The circuit breaker of claim 2 including lubricating material within said channel providing lubrication to said sphere.

6. The circuit breaker of claim 1 wherein said latch pin includes a support pin at an end of said latch pin opposite said dish-shaped opening, said support pin being retained within said trip bar.

7. The circuit breaker of claim 5 including a shank intermediate said latch pin and said support pin, said shank stopping against a surface of said trip bar.

8. The circuit breaker of claim 7 wherein said support pin includes a fluted surface to provide adherence between said support pin and said trip bar.

* * * * *